US007114920B2

(12) United States Patent
Synnott

(10) Patent No.: US 7,114,920 B2
(45) Date of Patent: Oct. 3, 2006

(54) SHROUD AND VANE SEGMENTS HAVING EDGE NOTCHES

(75) Inventor: Remy Synnott, St-Jean-sur-Richelieu (CA)

(73) Assignee: Pratt & Whitney Canada Corp., Longueuil (CA)

( * ) Notice: Subject to any disclaimer, the term of this patent is extended or adjusted under 35 U.S.C. 154(b) by 175 days.

(21) Appl. No.: 10/875,177

(22) Filed: Jun. 25, 2004

(65) Prior Publication Data

US 2005/0287001 A1 Dec. 29, 2005

(51) Int. Cl.
*F01D 5/22* (2006.01)

(52) U.S. Cl. ..... 415/173.1; 415/139; 415/209.3

(58) Field of Classification Search ..... 415/173.1, 415/139, 209.2, 209.3
See application file for complete search history.

(56) References Cited

U.S. PATENT DOCUMENTS 4,076,455 A * 2/1978 Stargardter ..... 416/191
4,222,708 A 9/1980 Davison ..... 415/127
4,460,316 A * 7/1984 Partington ..... 416/217
4,890,978 A 1/1990 McLaurin et al. ..... 415/209.4
5,174,715 A 12/1992 Martin ..... 415/209.4
5,191,711 A 3/1993 Vickers et al. ..... 29/889.21
5,271,714 A 12/1993 Shepherd et al. ..... 415/209.2
5,320,486 A 6/1994 Walker et al. ..... 415/139
5,553,999 A 9/1996 Proctor et al. ..... 415/173.1
6,296,443 B1 10/2001 Newman et al. ..... 415/209.2
6,309,177 B1 10/2001 Swiderski et al. ..... 415/173.2
6,502,304 B1 1/2003 Rigney et al. ..... 29/889.21
6,579,061 B1 6/2003 Heyward et al. ..... 415/189
6,899,518 B1 * 5/2005 Lucas et al. ..... 415/116

* cited by examiner

*Primary Examiner*—Ninh H. Nguyen
(74) *Attorney, Agent, or Firm*—Ogilvy Renault LLP

(57) ABSTRACT

Random air flow leakage between a shroud assembly and a stator vane assembly into the gas path of a gas turbine engine due to manufacturing tolerance stack-up is reduced by providing notches to inhibit interference caused by misalignment and/or mismatch of adjacent segments.

13 Claims, 6 Drawing Sheets

SHROUD AND VANE SEGMENTS HAVING EDGE NOTCHES

FIELD OF THE INVENTION

The present invention relates to a gas turbine engine, and more particularly to reducing the effect of manufacturing or assembly tolerance stack-up between a shroud assembly and an adjacent stator vane assembly.

BACKGROUND OF THE INVENTION

A gas turbine engine typically includes a plurality of shroud and stator vane segments in the turbine stages. Manufacturing and/or assembly tolerance stack-ups, however, typically results in axial mismatch between adjacent shroud segments and adjacent vane segments and/or circumferential misalignment of the shroud segments with the corresponding vane segments.

An example of such mismatch or misalignment is illustrated in FIG. 1 which is a schematic top view of turbine shroud segments 11*a*, 11*b* and two stator vane segments 13*a* and 13*b*. When a sealed connection between the shroud and the stator vane assemblies is required, the abutting edges 15, 16 of the respective shroud and stator vane segments should abut each other as a seal illustrated between the segments 11*b* and 13*b*. However, manufacturing tolerance stack-up typically results in a mismatch between abutting edges 16 of the respective segments 13*a*, 13*b*, and sides 20 thus misalign with sides 22 of the segments 11*a* and 11*b*. This results in a gap 18 which allows cooling air flowing through the shroud and vane segments to leak into the gas path, thereby causing inefficiency. It is difficult to control such airflow leakage when the engine system is designed because the existence and the dimensions of the gap 18 are essentially random (as tolerances intrinsically are).

Therefore, there is a need for controlling random leakage between the shroud assembly and the stator vane assembly of a gas turbine engine caused by tolerance stack-ups.

SUMMARY OF THE INVENTION

One object of the present invention is to provide improved control of airflow leakage in a gas turbine engine caused by tolerance stack-up.

In accordance with one aspect of the present invention, there is a shroud segment of a gas turbine engine, which comprises a body having a trailing edge, defined between a pair of trailing edge corners. There is provided at least one of the corners a notch defined therein, the notch being adapted to accommodate at least one of a circumferential misalignment and an axial mismatch between the body and an abutting edge of an adjacent vane segment when installed in the gas turbine engine.

In accordance with another aspect of the present invention, there is a shroud and vane assembly for a gas turbine engine, which comprises a plurality of shroud segments co-operating along a plurality of inter-shroud-segment interfaces to form an annular array having a vane-mating surface, and a plurality of vane segments co-operating along a plurality of inter-vane-segment interfaces to form an annular array having a shroud-mating surface adapted to mate with the vane-mating surface. There are notch means defined in at least one of the vane-mating and shroud-mating surfaces for accommodating tolerance-related discontinuity. Said tolerance-related discontinuity is caused by at least one of a circumferential misalignment and an axial mismatch of at least one of adjacent shroud segments and adjacent vane segments.

In accordance with a further aspect of the present invention, there is a method provided for controlling an airflow leakage between a shroud assembly and a vane assembly of a gas turbine engine, said leakage being caused by tolerance stack-up of shroud segments and of vane segments of the respective shroud assembly and vane assembly. The method comprises steps of (a) determining a maximum allowable tolerance stake-up of at least one of the shroud segments and the vane segments; and (b) providing a notch in at least one corner of the other one of the shroud segments and the vane segments, the notch being located and sized relative to said maximum allowable tolerance to correspond, when assembled, to any discontinuity due to such tolerance and thereby to inhibit assembly interference which would otherwise be caused by such discontinuity.

The present invention in one aspect advantageously reduces the randomness of air leakage between the shroud and stator vane assemblies by providing a smaller, and more substantially controllable leakage area. Therefore, the engine performance is improved.

Other features and advantages of the present invention will be better understood with reference to preferred embodiments described hereinafter.

BRIEF DESCRIPTION OF THE DRAWINGS

Reference will now be made to the accompanying drawings, showing by way of illustration preferred embodiments, in which.

DETAILED DESCRIPTION OF THE PREFERRED EMBODIMENTS

Figure 1:
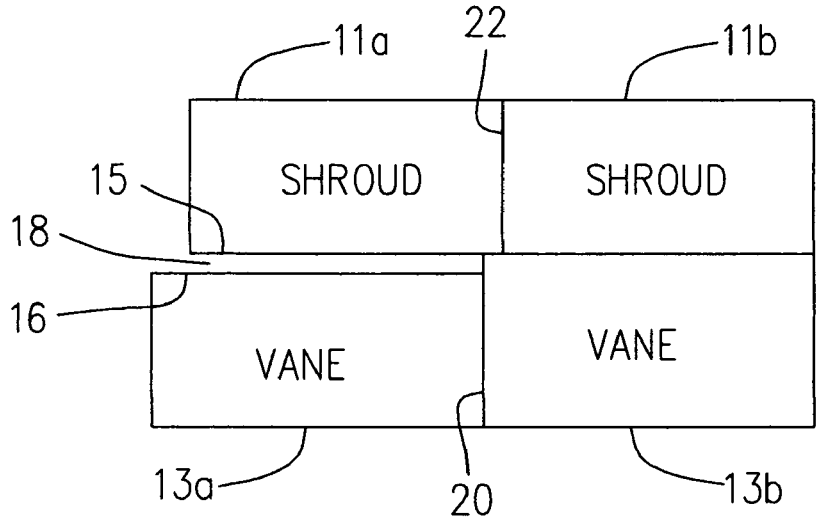
FIG. 1 (PRIOR ART)
FIG. 1 is a schematic top plane view of adjacent shroud segments and stator vane segments, showing the random gaps between the shroud and stator vane segments causing leakage in conventional designs.
Figure 3:
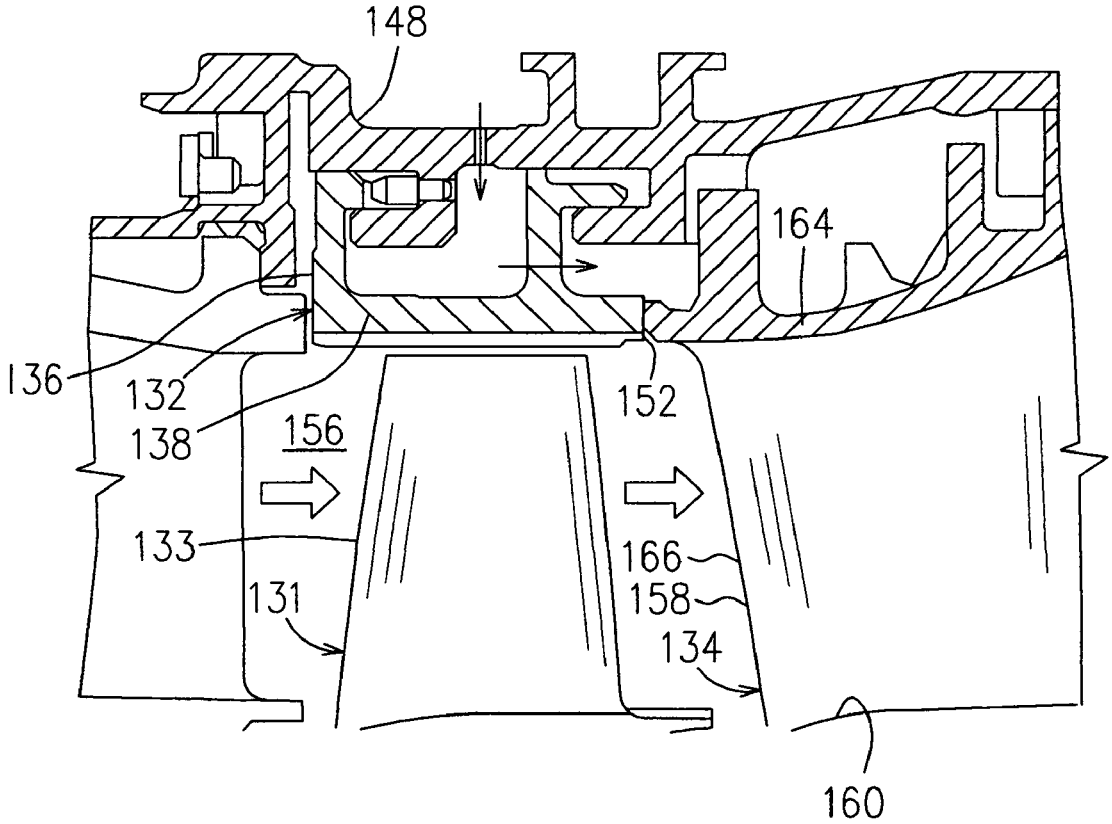
FIG. 3 is a partial cross-sectional view of the gas turbine engine of FIG. 2, showing the shroud assembly and the stator vane assembly incorporating one embodiment of the present invention.
Figure 2:
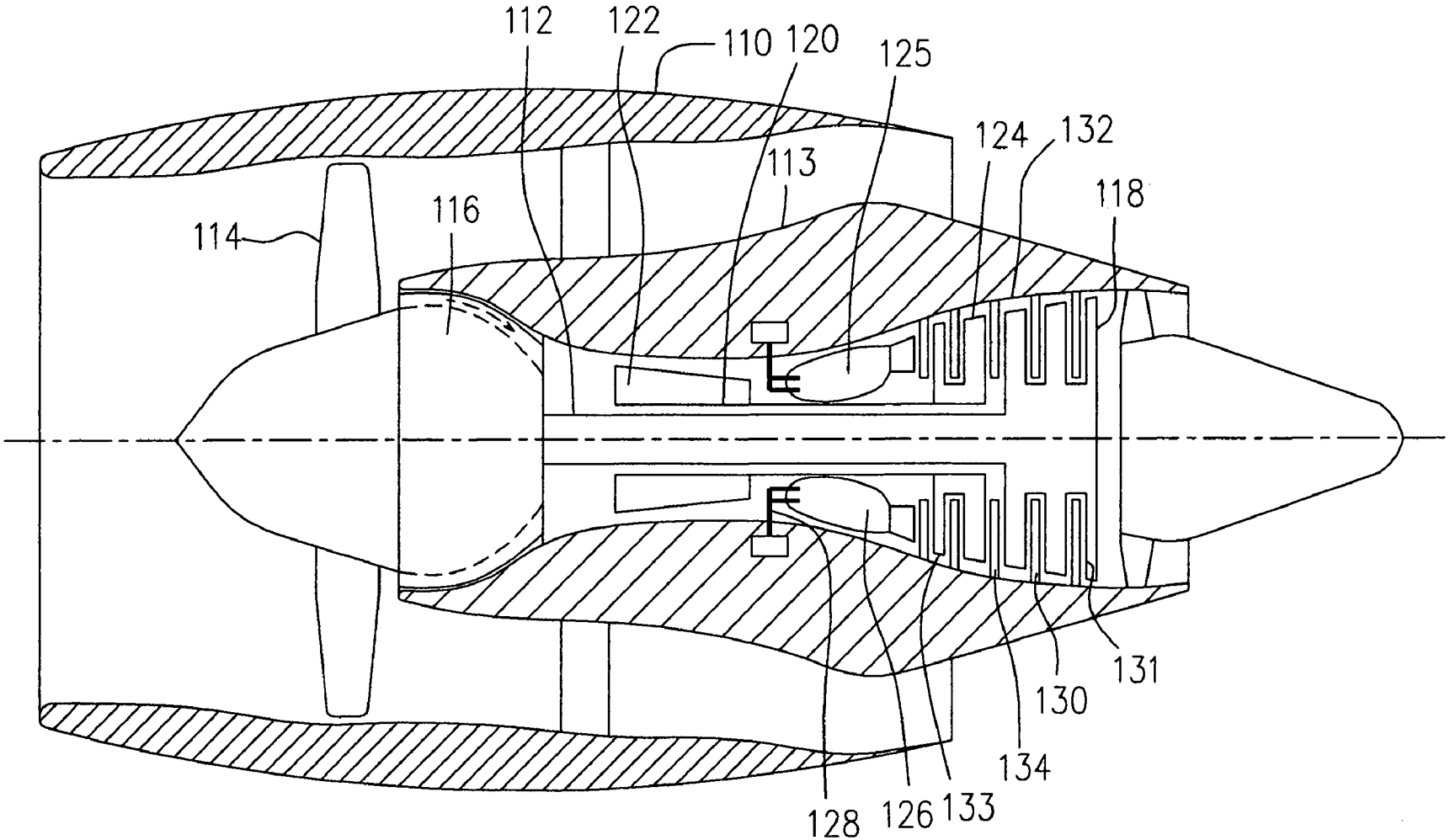
FIG. 2 is a schematic cross-sectional view of a gas turbine engine, showing an exemplary application of the present invention.
Figure 4:
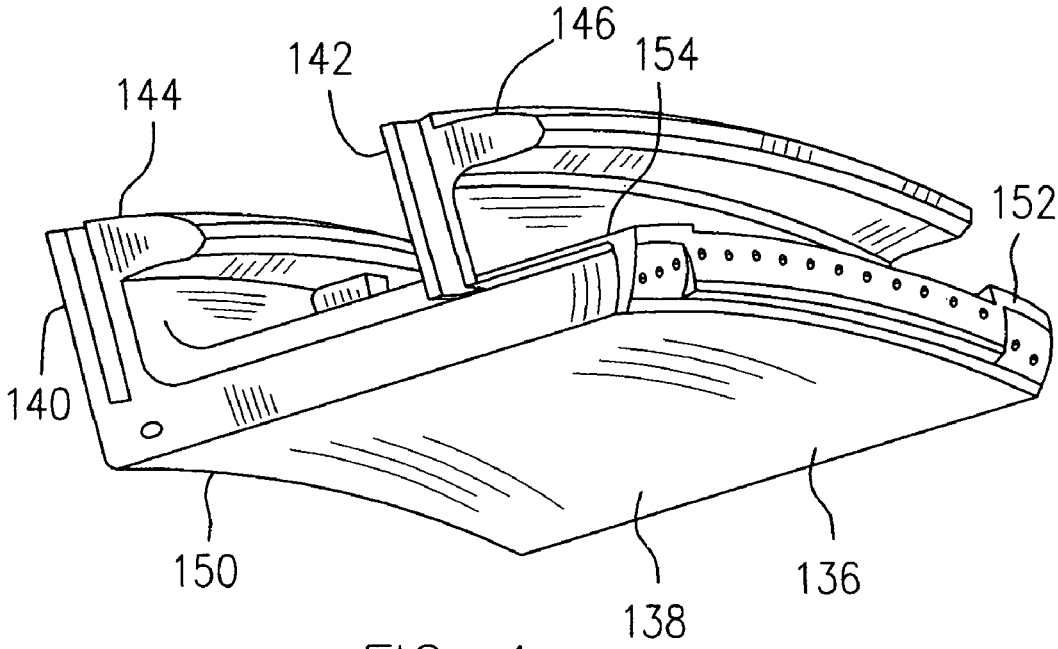
FIG. 4 is a perspective view of a shroud segment used in the shroud assembly of FIG. 3.
Figure 4A:
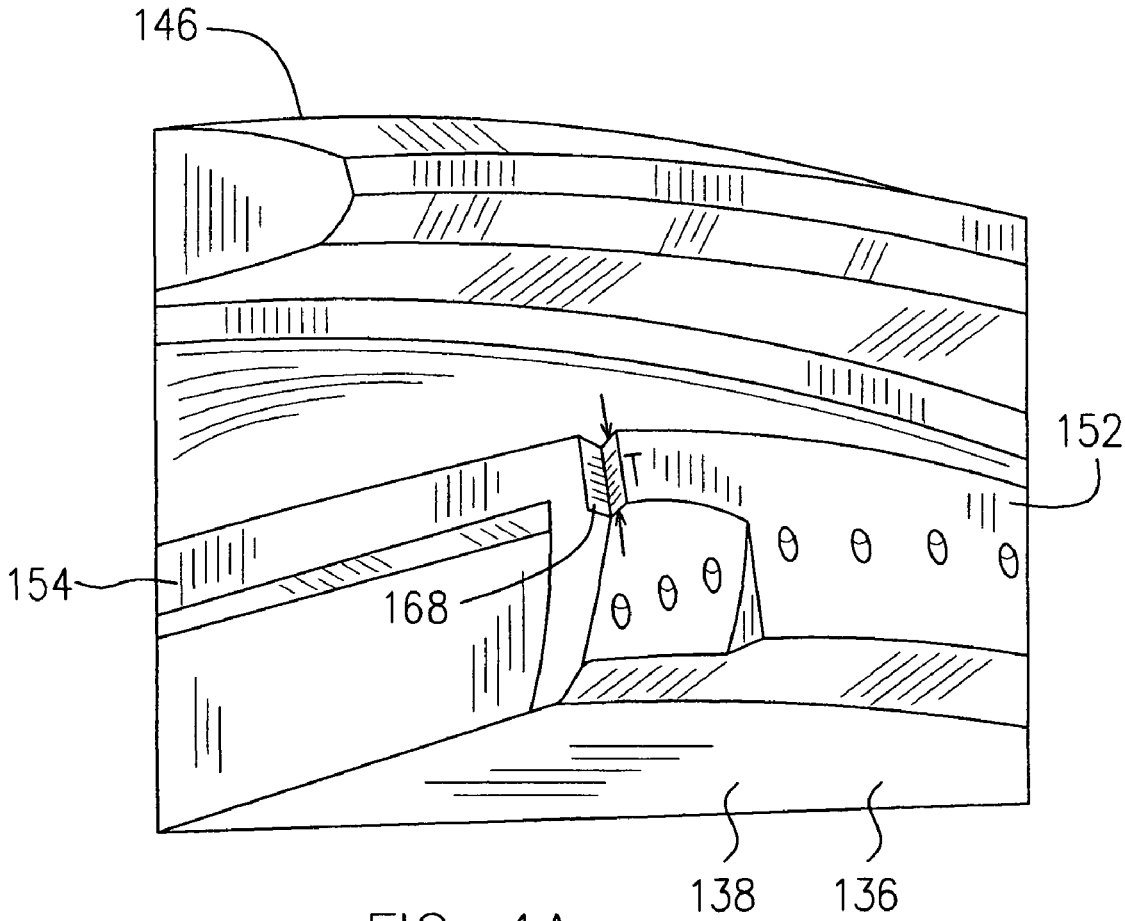
FIG. 4A is an enlarged partial perspective view of the shroud segment of FIG. 4, showing a notch provided on the corner thereof.

Referring to FIGS. 2 and 3, a turbofan gas turbine engine incorporates an embodiment of the present invention, presented as an example of the application of the present invention, and includes a housing or a nacelle 110, a core casing 113, a low pressure spool assembly seen generally at 112 which includes a fan 114, low pressure compressor 116 and low pressure turbine 118, and a high pressure spool assembly seen generally at 120 which includes a high pressure compressor 122 and a high pressure turbine 124. There is provided a burner seen generally at 125 which includes an annular combustor 126 and a plurality of fuel injectors 128 for mixing liquid fuel with air and injecting the mixed fuel/air flow into the annular combustor 126 to be ignited for generating combustion gases. The low pressure turbine 118 and high pressure turbine 124 include a plurality of stator vane stages 130 and rotor stages 131. Each of the rotor stages 131 has a plurality of rotor blades 133 encircled by a shroud assembly 132 and each of the stator vanes stages 130 includes a stator vane assembly 134 which is positioned upstream and/or downstream of a rotor stage 131 for directing combustion gases into or out of an annular gas path within a corresponding shroud assembly 132 and through the corresponding rotor stage 131.

Referring to FIGS. 2, 3, 4 and 4A, a combination of a turbine shroud assembly 132 and a stator vane assembly 134 is described. The shroud assembly 132 includes a plurality of shroud segments 136 (only one shown) each of which includes a shroud ring section 138 having two radial legs 140, 142 with respective hooks 144, 146 conventionally supported within an annular shroud support structure formed with a plurality of shroud support segments 148. The annular shroud support structure is in turn supported within the core casing 113. Each of the shroud segments 136 includes a leading edge 150, a trailing edge 152 and opposed sides 154, thereby defining the shroud ring section 138. The shroud segments 136 are joined one to another in a circumferential direction and thereby form the shroud assembly 132 which encircles the rotor blades 133, in combination with the rotor stage 131, thereby defining a section of an annular gas path 156.

The stator vane assembly 134 is, for example disposed downstream of the rotor stage 131, and includes a plurality of stator vane segments 158 (only one shown) joined one to another in a circumferential direction. Each of the stator vane segments 158 includes an inner platform 160 conventionally supported on a stationary support structure (not shown) and an outer platform 164 which is conventionally supported within the annular shroud support segment 148. One or more (only one shown) air foils 166 radially extending between the inner and outer platforms 160, 164 divide a downstream section of the annular gas path 156 relative to the rotor stage 131, into sectoral gas passages for directing combustion gas flow out of the rotor stage 131.

Compressed cooling air (as indicated by the arrows in FIG. 3) are introduced within the shroud support structure to cool the shroud assembly 132 and the stator vane assembly 134. Therefore, it is desirable to ensure that the trailing edge 152 of each shroud segment 136 abuts a corresponding abutting edge (not indicated) of the outer platform 164 of a corresponding stator vane segment 158, thereby providing a seal between the shroud assembly 132 and the stator vane assembly 134 in order to impede cooling air flow from leaking into the gas path 156, which causes cooling air to be wasted and thereby adversely affects engine performance efficiency.

Figure 5:
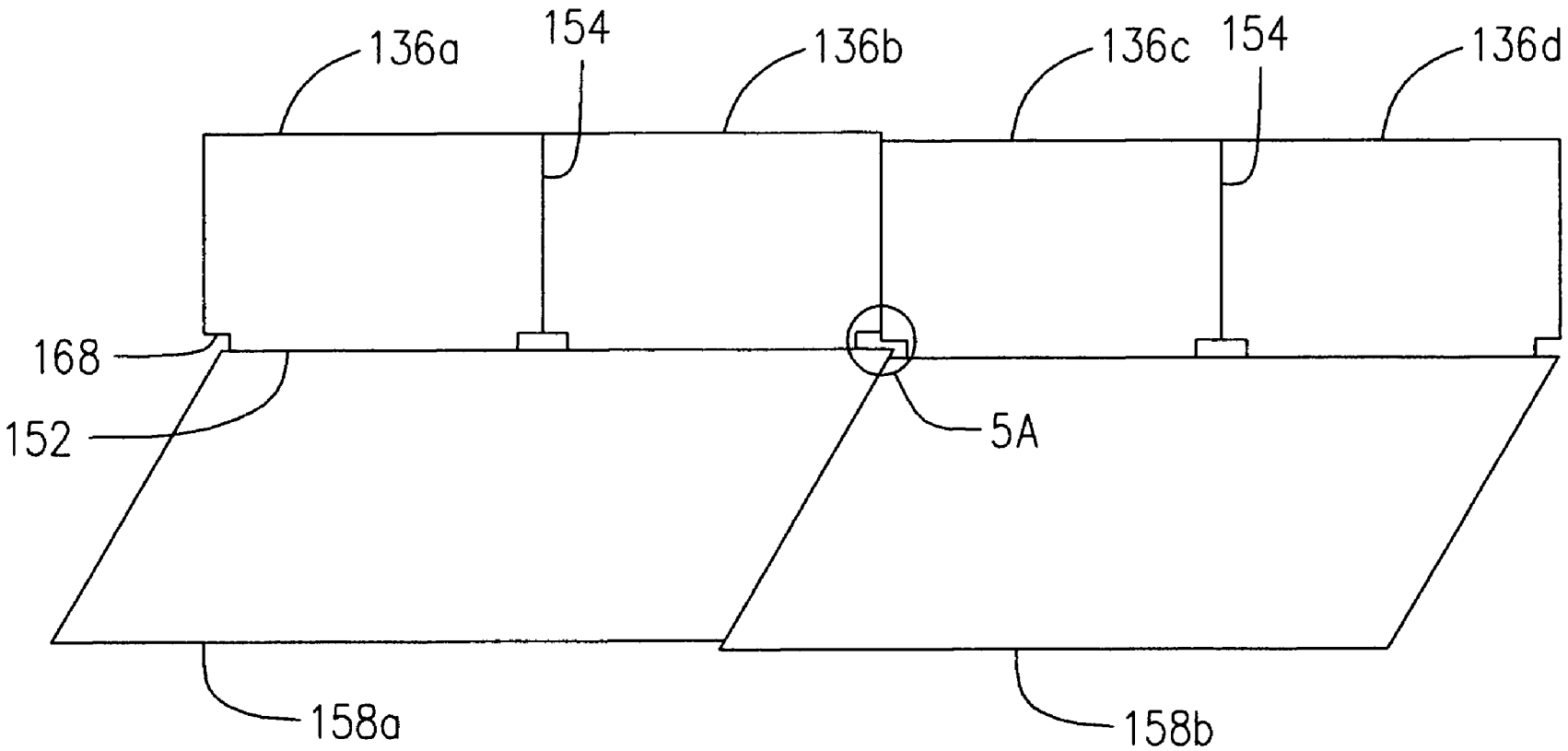
FIG. 5 is a schematic partial top plane view of the shroud and stator vane assemblies of FIG. 8, illustrating the adjacent corners of the adjacent segments thereof.
Figure 5A:
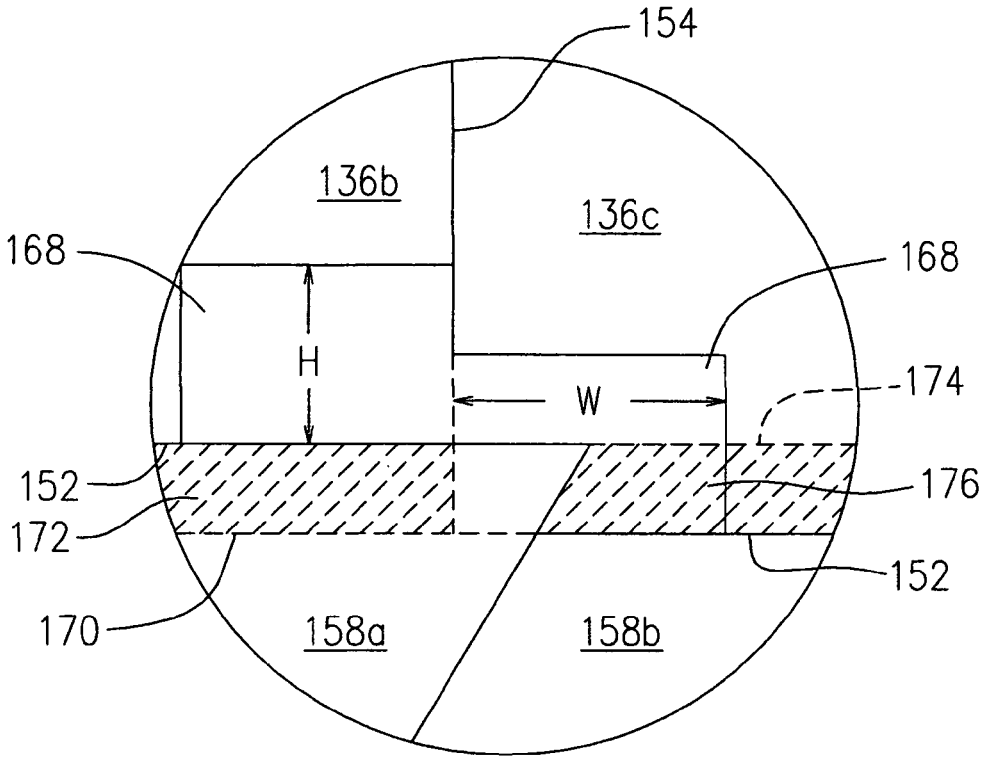
FIG. 5A is an enlarged encircled area 5A of FIG. 5, illustrating details of the adjacent corners of the adjacent segments thereof.

Referring to FIGS. 5 and 5A, the number of the shroud segments 136 (four are shown as 136*a*–136*d* for convenience of description) is preferably equal to or greater than (in whole-number multiples of) the number of the stator vane segments 158 (two are shown as 158*a* and 158*b* for convenience of description) such that each of the stator vane segments 158*a*, 158*b* usually aligns with one or more shroud segments 136*a*–136*d* in a circumferential direction. It should be noted that the alignment of the stator vane segments 158*a*, 158*b* with the shroud segments 136*a*–136*d* results in the interface of the edges of the adjacent stator vane segments 158*a* and 158*b* which abut abutting edges of the corresponding adjacent shroud segments 136*a*–136*d*, aligning with a interface line representing the interfacing sides 154 of adjacent shroud segments 136*a*–136*d* in a top plane view thereof.

In this embodiment of the present invention, the shroud and stator vane segments 136*a*–136*d* and 158*a*, 158*b* are sized such that each of the stator vane segments 158*a*, 158*b* can align with and abut two corresponding shroud segments 136*a*–136*d*. Each of the shroud segments 136*a*–136*d* has at least one, but preferably both, corners at the trailing edge 152 removed (i.e. the corners are not "square" as in the prior art, but rather a "notched"). In this embodiment, a notch 168 radially (i.e. in the direction through the thickness of the segment) extends from an inner surface of the corner of the abutting edge (the trailing edge 152) of the shroud segments 136*a*–136*d* (more clearly shown in FIG. 4*a*). With notches 168 provided at the corners of the trailing edge 152 of the shroud segments 136*a*–136*d*, the abutting edges of the stator vane segments 158*a*, 158*b* mate with abutting edges (the trailing edge 152) of the corresponding shroud segments 136*a*–136*d* and can thereby provide an effective sealing surface between the shroud assembly 132 and the stator vane assembly 134 of FIG. 3. This is because the notch 168 can "absorb" and interface discontinuity caused by any axial mismatch and circumferential misalignment of the stator vane segments 158*a*, 158*b* and the shroud segments 136*a*–136*d* which may be present due to an tolerancing issue or tolerance stack-up.

The notches 168 are thus provided to eliminate tolerance-related interference of the assembled stator vane and shroud segments. As illustrated in FIG. 5A, if the notches 168 of the shroud segments 136*b* and 136*c* were not present, the corner of stator vane segment 158*a* would interfere with the corner of the shroud segment 136*c*. With the prior art in such a situation, either the stator vane segment 158*a* would have to be repositioned to axially match the joined stator vane segment 158*b* as indicated by broken line 170, thereby leaving a gap (illustrated by the shaded area 172) between the shroud segments 136*b* and the stator vane segment 158*a*, or the shroud segment 136*c* would have to be repositioned to match the joined shroud segment 136*b* as indicated by the broken line 174, thereby leaving also a gap (illustrated as the shaded area 176) between the shroud segment 136*c* and the stator vane segment 158*b*.

Each of the notches 168 has preferably a width W in a circumferential (or angular) direction relative to the assembly of shroud segments 136, and W is preferably greater than a total expected tolerance stack-up expected at that location, thereby permitting the notch to "absorb" or accommodate even the maximum expected circumferential misalignment. Similarly, each of the notches 168 preferably has a height H in an axial direction of the shroud segment 136, where H is preferably also greater than a total expected tolerance stack-up, to permit accommodation of the maximum possible axial mismatch of the joined shroud segments 136 and the stator vane segments 158. Referring again to FIG. 4A, the notch also has a thickness T (in the radial or thickness direction relative to the segment assembly), which may be sized appropriately in the same manner. It will be understood the W, H and T need not be constant, and that notch 168 may have any suitable shape and size. Preferably, notches 168 is kept as small as necessary, to reduce the amount of secondary air flow leakage into the primary gas path.

While the notches 168 provided on the corners of the trailing edge 152 of the shroud segments 136 do create new leakage areas at the adjacent corner areas of the joined shroud and stator vane segments, the advantage present by the present invention is that these new leakage areas are potentially much smaller than gaps cause by tolerance-stackups. Furthermore, since the size of the notch gaps may be much more accurately predetermined, as compared with one's ability (or inability, rather) to predict size of the random gaps 172 or 176 which will occur when the notches 168 are not provided, the design is much better able to optimize his system. For example, when the shroud assembly 132 includes 24 shroud segments of 1.750 units in a circumferential dimension and four of them are mismatched by 0.004 units, the total leakage area is 0.028 square units. In contrast, when each shroud segment is provided with two notches of 0.045 units by 0.007 units, the notch area per shroud segment is 0.00063 square units, or a combined 0.01512 square units. The skilled reader will understand that the notch gap area will in fact be further reduced if a mismatch or misalignment is present. The notches provided on the corners of the shroud segments can also accommodate thermal expansion variation such as, for example, any axial thermal expansion variation which may occur in the circumferential direction if there is a hot streak present in the engine.

Figure 6:
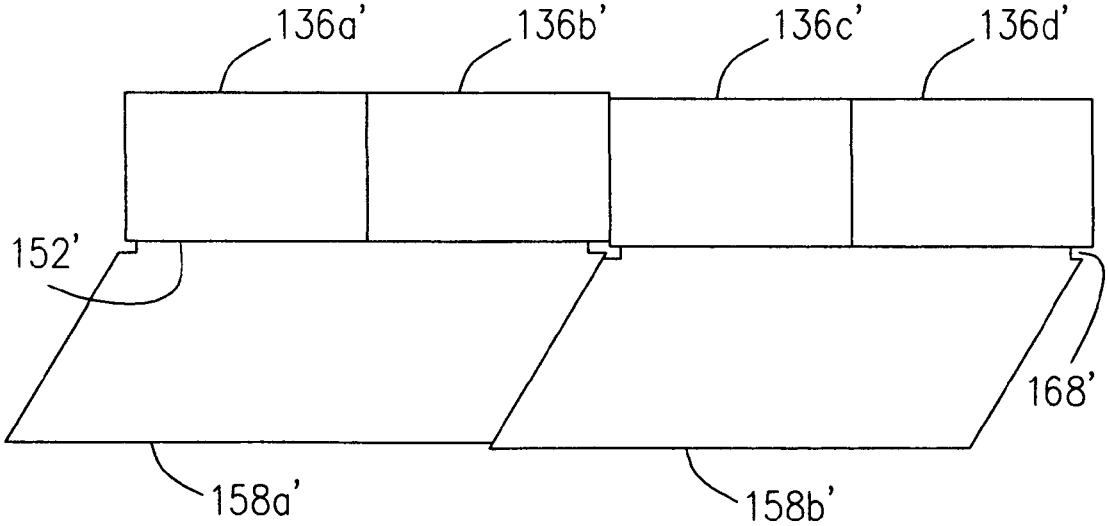
FIG. 6 is a partial schematic top plane view of a shroud assembly and a stator vane assembly, incorporating another embodiment of the present invention.

FIG. 6 illustrates an alternate embodiment of the present invention in which shroud segments 136*a*'–136*d*' may be substantially identical to shroud segments 136*a*–136*d* of FIG. 5, with the exception that notches 168' are provided on of each of the stator vane segments 158*a*' and 158*b*'. The notches 168' of the stator vane segments 158*a*'and 158*b*', like the notches 168 of the shroud segments 136*a* to 136*d* of FIG. 5, are adapted to reduce, and preferably prevent altogether, interference between adjacent shroud and stator vane segments due to tolerance stack-up.

The notches can thus be provided either on the shroud segments or the stator vane segments. It is not necessary to have notches at both corners, but this is preferred. Likewise, each shroud or vane segments need not have a notch as, particularly, for example, where the multiples of vane to shroud segments dictates that mismatch/misalignment cannot occur at the location of certain segment (e.g. see FIG. 7, is which some notches exists where inter-segment interfaces are not present).

Figure 7:
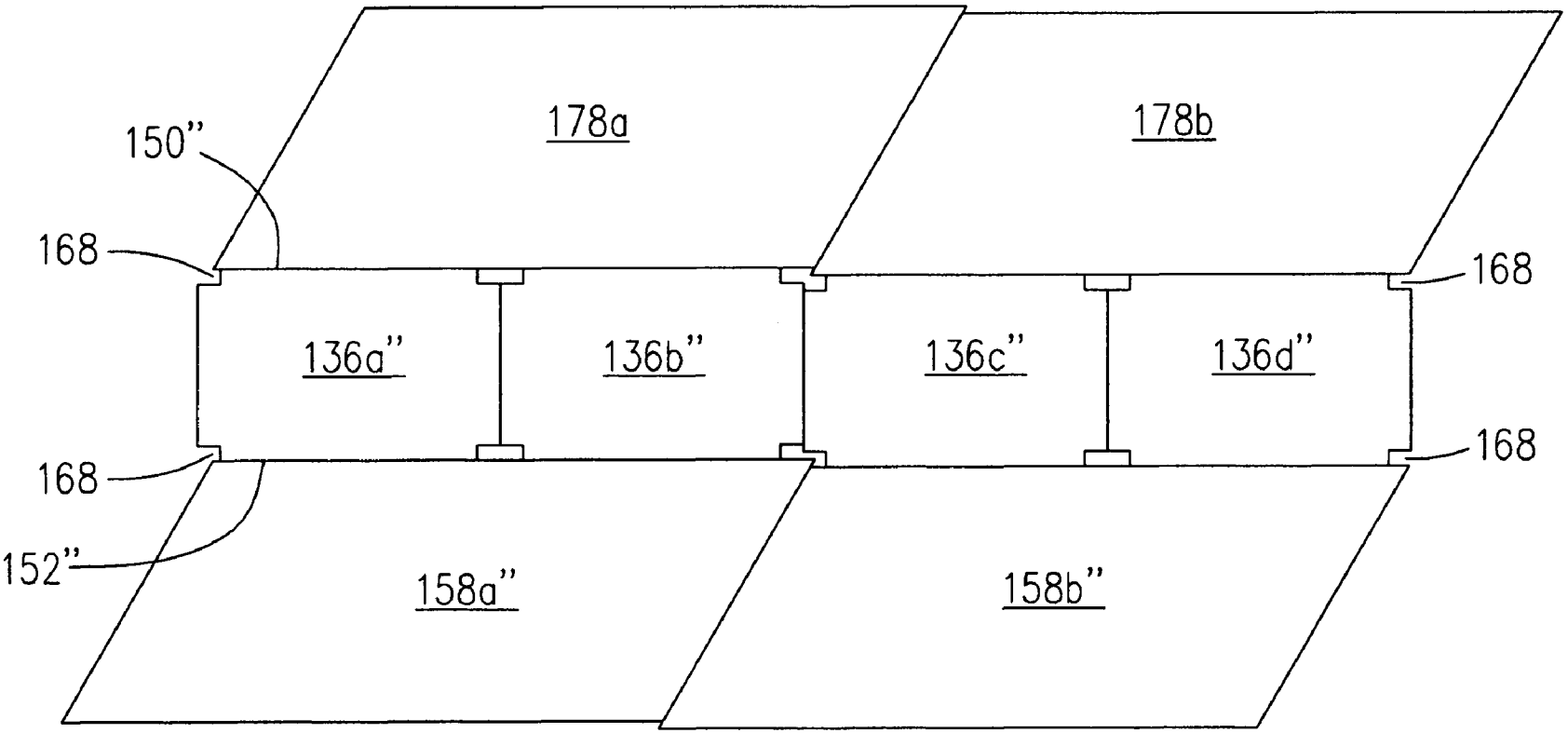
FIG. 7 is a partial schematic top plane view of a shroud assembly disposed between first and second stage stator vane assemblies according to a further embodiment of the present invention.

FIG. 7 illustrates a further embodiment of the present invention, in which the the invention is applied on both sides of the shroud assembly. The stator vane segments 158*a*" and 158*b*" are preferably substantially as describe above, but the upstream and downstream notches need not necessarily be configured similarly.

The shroud segments 136*a*"–136*d*" are preferably substantially as described above, with the exception that each of the four corners are provided with notched 168.

It should also be understood that the drawings are used to illustrate the concept and principle of the present invention and do not present the physical proportional configuration of the gas turbine engine parts. The notches are exaggerated in the drawings in order to more clearly illustrate the functional features thereof. In this application, the term "notch" is intended to refer broadly to an absence of material in a body which may therefore accommodate an adjacent discontinuity by reason of such absence of material. Although it has been described above that a corner may be "removed" to provide a notch, this concept is used for illustration only, and is not intended to imply a particular manufacturing approach is required. An article including the present invention may be manufactured in any suitable fashion.

Modifications and improvements to the above-described embodiments of the present invention will be apparent to those skilled in the art. For example, the size, placement and configuration of the notches need not bee as shown, but may be in any desired or required form to achieve the teachings of the present application. Although it is desired to address both circumferential misalignment and axial mismatch between segments, the invention may also be applied to address either one or the other alone. Also, although described with reference to a segment corner notch, the invention may be applied instead, or additionally, by the provision of a notch wholly contained within a segment trailing or leading (i.e. not on a corner). Also, although the figures show a shroud-to-vane segment ratio of 2:1, the invention may be applied with just about any ratio, with vane number exceeding the shroud, or vice versa. The foregoing description is intended to be exemplary rather than limiting. The scope of the present invention is therefore intended to be limited solely by the scope of the appended claims.

I claim:

1. A shroud segment of a gas turbine engine, the segment comprising:

a body having a trailing edge defined between a pair of trailing edge corners and a leading edge defined between a pair of leading edge corners, at least one of the leading edge corners and at least one of the trailing edge corners having a notch defined therein, respectively, each of the notches adapted to accommodate at least one of a circumferential misalignment and an axial mismatch between the body and an abutting edge of an adjacent vane segment when installed in the gas turbine engine.

2. The shroud segment as claimed in claim 1, wherein each of the trailing edge corners has one of said notches.

3. The shroud segment as claimed in claim 1, wherein each of the leading edge corners has one of said notches.

4. A shroud and vane assembly for a gas turbine engine, the assembly comprising:

a plurality of shroud segments co-operating along a plurality of inter-shroud-segment interfaces to form an annular array having a vane-mating surface;

a plurality of vane segments co-operating along a plurality of inter-vane-segment interfaces to form an annular array having a shroud-mating surface adapted to mate with the vane-mating surface; and notch means defined in a shroud-mating surface for accommodating tolerance-related discontinuity, said tolerance-related discontinuity caused by at least one of circumferential misalignment and axial mismatch of at least one of adjacent shroud segments and adjacent vane segments.

5. The assembly as claimed in claim 4, wherein each of the vane segments include said notch means.

6. The assembly as claimed in claim 5, wherein said notch means includes a pair of notches located at corners thereof.

7. The assembly as claimed in claim 4, wherein the notch means has a size greater than an allowed maximum tolerance stack-up.

8. The assembly as claimed in claim 4, wherein the number of vane segments is a whole-number multiple of the number of shroud segments.

9. The assembly as claimed in claim 4, wherein the number of shroud segments is a whole-number multiple of the number of vane segments.

10. A method of controlling an air flow leakage between a shroud assembly and a vane assembly of a gas turbine engine, said leakage being caused by tolerance stack-up of shroud segments and of vane segments of the respective shroud assembly and vane assembly, the method comprising steps of: (a) determining a maximum allowable tolerance stack-up of at least one of the shroud segments and the vane segments; and (b) providing a notch in at least one corner of the other one of the shroud segments and the vane segments, the notch being located and sized relative to said maximum allowable tolerance to correspond, when assembled, to any discontinuity due to such tolerance and thereby to inhibit assembly interference which would otherwise be caused by such discontinuity.

11. The method as claimed in claim 10, wherein the notch extends radially along the at least one corner of the other one of the shroud segments and vane segments, having a substantially predetermined depth and width such that a substantially predetermined air flow leakage area at the at least one corner of the other one of the shroud segments and vane segments replaces said assembly interference.

12. The method as claimed in claim 11, wherein the substantially predetermined width of the notch is greater then a total amount of allowed maximum tolerance stake-ups of both the shroud segments and the vane segments in a circumferential dimension thereof.

13. The method as claimed in claim 11, wherein the substantially predetermined depth of the notch is greater than a total amount of allowed maximum tolerance of both a shroud segment and a vane segment in an axial dimension thereof.

* * * * *